US006739829B2

(12) United States Patent
Addie

(10) Patent No.: US 6,739,829 B2
(45) Date of Patent: May 25, 2004

(54) SELF-COMPENSATING CLEARANCE SEAL FOR CENTRIFUGAL PUMPS

(75) Inventor: Graeme R. Addie, Martinez, GA (US)

(73) Assignee: GIW Industries, Inc., Grovetown, GA (US)

( * ) Notice: Subject to any disclaimer, the term of this patent is extended or adjusted under 35 U.S.C. 154(b) by 58 days.

(21) Appl. No.: 10/190,871

(22) Filed: Jul. 8, 2002

(65) Prior Publication Data

US 2004/0067132 A1 Apr. 8, 2004

(51) Int. Cl.[7] ..... F04D 29/06; F04D 29/16

(52) U.S. Cl. ..... 415/1; 415/110; 415/172.1; 415/174.1; 415/174.3; 415/174.4; 277/369; 277/387; 277/429

(58) Field of Search ..... 415/1, 110–113, 415/172.1, 173.2, 173.3, 173.4, 174.1, 174.2, 174.3, 174.4; 77/369, 370, 387, 428, 429

(56) References Cited

U.S. PATENT DOCUMENTS 2,736,265 A * 2/1956 Higgins ..... 415/172.1
3,516,757 A * 6/1970 Baumann ..... 415/112
5,971,704 A * 10/1999 Blattmann ..... 415/173.2

FOREIGN PATENT DOCUMENTS

JP 45-33481 A * 10/1970

* cited by examiner

*Primary Examiner*—Christopher Verdier
(74) *Attorney, Agent, or Firm*—Womble Carlyle Sandridge & Rice, PLLC

(57) ABSTRACT

A seal for use in a centrifugal pump of the type used for pumping an abrasive slurry, and having a sealing ring groove formed in the pump casing and an arrangement for supplying flushing water, comprising a radial seal having a sealing end, a water receiving end, and opposed sides and adapted for installation within the sealing ring groove, the radial seal having multiple openings formed therethrough for the passage of flushing water. The openings are dimensioned and located so that when flushing water is supplied to the water receiving end of the radial seal, the water flows through the openings, causing the radial seal to automatically moves to a self-compensating balanced position between the pump casing and a rotating pump impeller. This will reduce leakage between the pump casing and pump impeller and reduce wear of the pump surfaces.

17 Claims, 6 Drawing Sheets

SELF-COMPENSATING CLEARANCE SEAL FOR CENTRIFUGAL PUMPS

FIELD OF THE INVENTION

This invention relates generally to centrifugal pumps, and, more particularly to lubricating pump seals for centrifugal pumps that act to reduce wear between the rotating and stationary surfaces of pumps used to pump a mixture of solids and carrier liquid, commonly known as slurry.

BACKGROUND OF THE INVENTION

Centrifugal pumps, as the name implies, employ centrifugal force to life liquids from a lower to a higher level or to produce a pressure. This type of pump, in its simplest form, comprises an impeller consisting of a connecting hub with a number of vanes and shrouds, rotating in a volute collector or casing (See FIGS. 1 and 2). Liquid drawn into the center, or eye, of the impeller is picked up by the vanes and accelerated to a high velocity by rotation of the impeller. It is then discharged by centrifugal force into the casing and out the discharge branch of the casing. When liquid is forced away from the center of the impeller, a vacuum is created, causing more liquid to flow into the center of the impeller. Consequently there is a continuous flow through the pump.

The rotation of the impeller vanes results in a higher pressure in the volute collector than in the suction, which results in flow. This higher pressure has to be sealed against the lower pressure suction on one side and where the shaft (at a lower atmospheric pressure) on the other side enters the collector, to avoid leakage losses and loss of performance. In the case of the shaft, the most common sealing method is to utilize a stuffing box with rings of packing. On the front, or suction side, with water pumps the most common method of sealing is to utilize a close radial clearance between the impeller and the casing and to employ radial seal rings. For pumps used to pump slurry, the sealing problem is more difficult. While radial seal rings are effective in clean water pump applications, experience has shown that the particles being pushed through the gap between the sealing surfaces are thrown off the rotating radial surface of the impeller seal ring causing high wear to the wetted surfaces of the pump.

Wear occurs mostly as a result of particles impacting or sliding on the wetted surfaces. The amount of wear depends on the particle size, shape, specific gravity of the solids, and sharpness of the particulate matter, most of which is dictated by the service and the velocity of impact (or concentration) of the solids.

In order to redue wear, some pumps employ a water flush to dilute and exclude particles, some utilize semi-axial gaps tapering inwards at an angle, and some utilize clearing vanes protruding out of the front shroud of the impeller into the gap between the impeller and the suction liner. Each of these, however, has either not satisfactorily solved the problem of wear, or has reduced wear at the expense of pump efficiency. What is needed is a seal construction that is simple, effective in reducing wear, and that does not impair the performance of the pump.

SUMMARY OF THE INVENTION

The present invention is directed to a simple, cost-effective sealing assembly for centrifugal pumps that addresses each of the problems described above specifically, the sealing assembly is adaptable for use in a centrifugal pump of the type used for pumping an abrasive slurry where wear due to particulate matter is particularly problematic. The seal assembly may be installed in a pump that has, or can be modified to include, a sealing ring groove in the stationary pump casing and a means for supplying clean, pressurized flush water into the sealing ring groove. While the present invention may be installed on a variety of pump types, exemplary installation on a single-stage, single-suction centrifugal pump will be explained in detail herein.

One embodiment of the present invention includes a radial seal that is positioned within the sealing ring groove of the stationary pump casing of a centrifugal pump. The radial seal is dimensioned to be smaller than the groove so that it may freely move within the groove. The radial (circular) seal has a generally rectangular cross section and is formed of a wear-resistant malleable iron, elastomer, or ceramic material, though an elastomer is preferred.

The seal comprises a sealing, or forward, end and a flushing water inlet, or rear, end. The rear end of the seal includes at least one orifice through which pressurized seal water is received. The sealing end of the seal includes multiple, spaced perforations through which the flush water evenly flows. The perforations are sized so that their combined surface area is less than the area of the inlet surface orifice of the seal or the sealing ring groove. This ensures that when pressurized flush water is supplied to the sealing ring groove, the pressure forces the seal to protrude outwardly from the sealing ring groove into the gap between the stationary pump casing and the rotating impeller surface. Hydrostatically, as the seal approaches the surface of the impeller, back pressure between the impeller and the radial seal increases. This balances the pressure on the seal so that the seal does not directly contact the impeller with any significant rubbing force. In this manner, seal wear is minimized, while the seal water provides lubrication and cleaning of the wetted surfaces.

In another embodiment, the sealing end of the seal of the present invention has a centrally-formed recessed region. Desirably, it creates a "shower head", or conical, distribution of flush water. Formed in this fashion, the flush water is caused to spread out from the perforations onto an even larger predetermined surface area. When the flush water enters the recessed portion, pressure in the recessed portion builds, again balancing the hydrostatic force between the seal and the impeller surface, so that the seal moves outward, but never actually contacts the impeller.

In both of the described embodiments of the present invention, the hydrostatic balance between the seal and the pump impeller forms a "self-compensating" clearance that not only reduces pump wear, but also ensures more efficient pump operation.

These and other aspects of the present invention will become apparent to those skilled in the art after a reading of the following description of the preferred embodiments when considered in conjunction with the drawings. It should be understood that both the foregoing general description and the following detailed description are exemplary and explanatory only and are not restrictive of the invention as claimed.

DETAILED DESCRIPTION OF THE PREFERRED EMBODIMENTS

Figure 1:
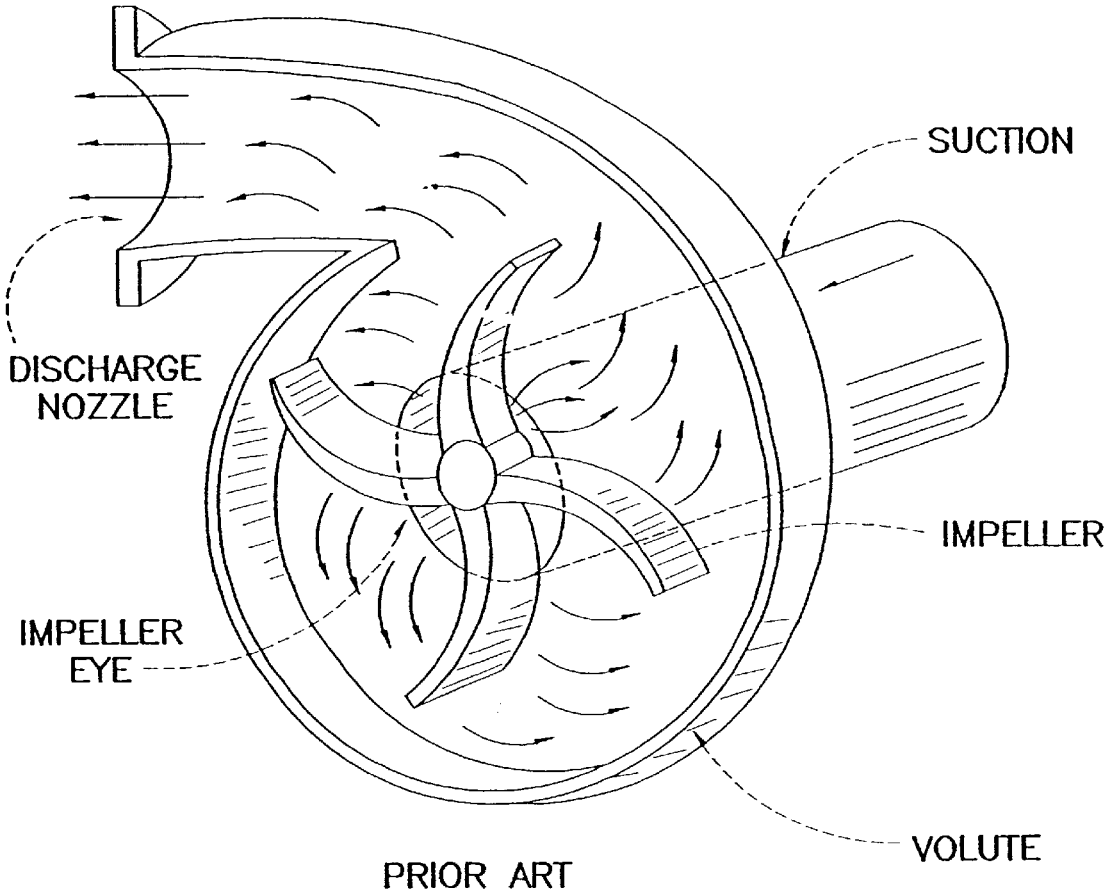
FIG. 1 is a simplified schematic illustrating the fundamental components and operation of a conventional single stage centrifugal pump (Prior Art)
Figure 2:
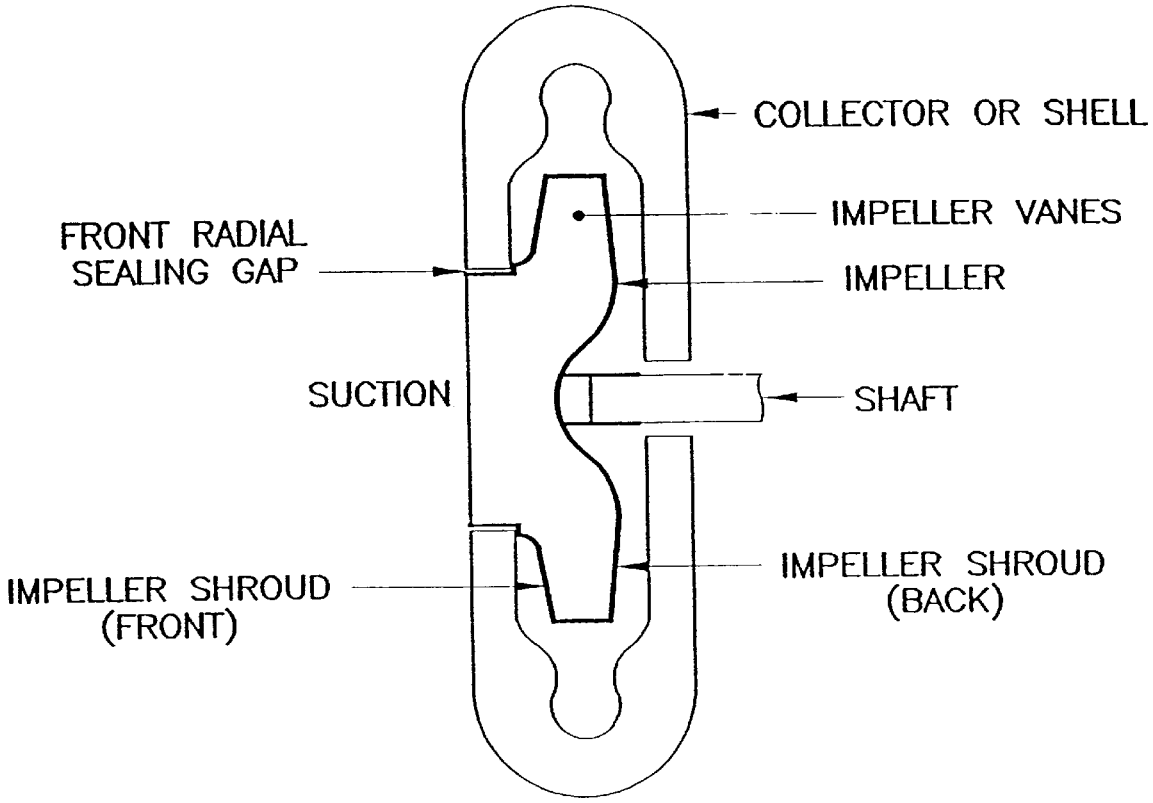
PRIOR ART FIG. 2
FIG. 2 is a cross-sectional view of the interior of a conventional single stage centrifugal pump (Prior Art)
Figure 3:
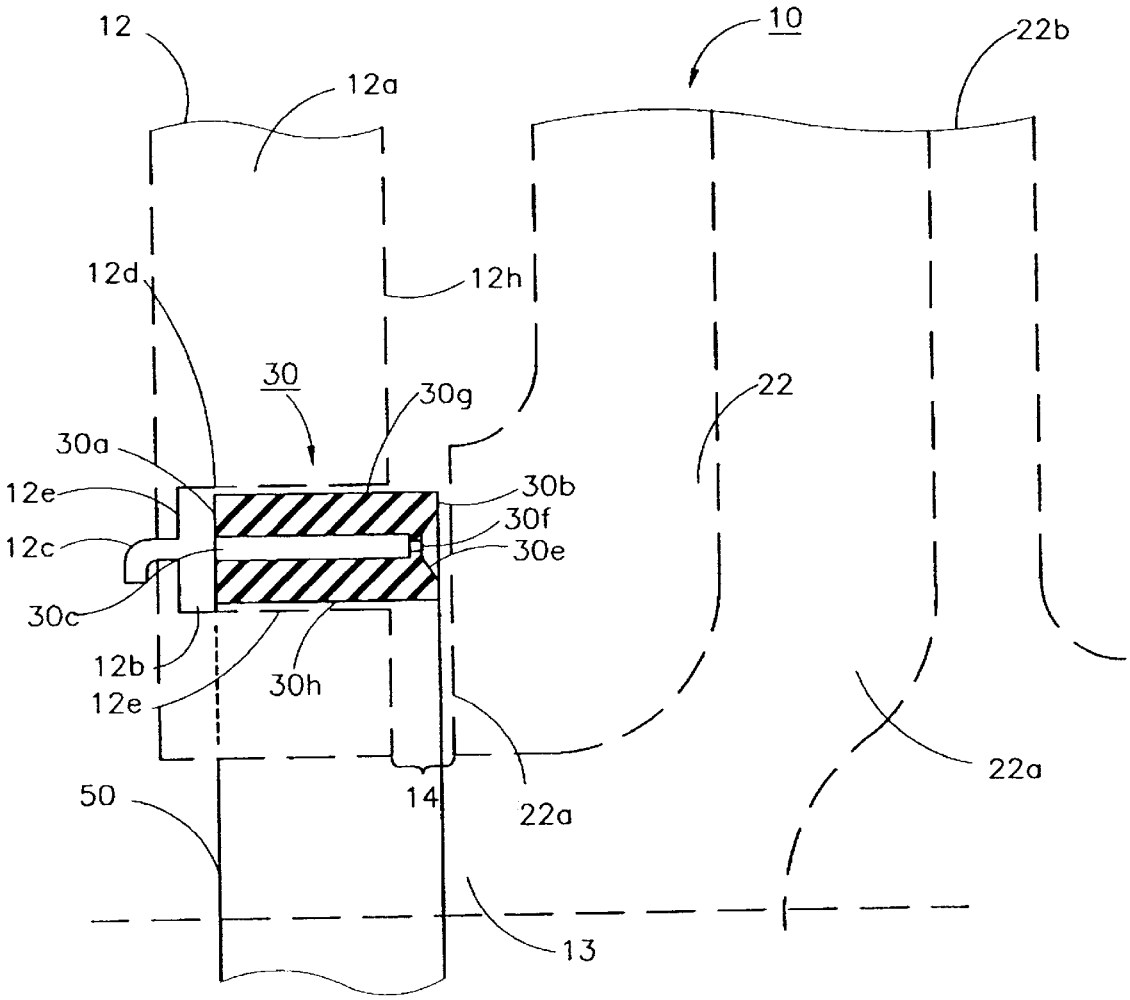
FIG. 3 is a close-up side view of the radial sealing gap area of FIG. 2, illustrating the placement of the seal of the present invention.

Referring now to FIG. 3, a close-up sectional view is shown of the impeller nose gap and pump casing sealing surfaces for a single-suction, single-stage centrifugal slurry pump, designated generally as 10.

Pump 10 comprises a stationary casing, or volute, 12 that houses the single impeller 22. As is conventional for centrifugal pumps, impeller 22 is rotated by a shaft (not shown) that is coupled to a motive power source (not shown) such as an electric motor. Aligned axially with impeller 22 is the pump suction inlet 13. Suction inlet 13 is the point of entry for slurry being drawn into the impeller 22. Suction inlet 13 is typically coupled to a suction source via piping (not shown) that mates with a suction flange surrounding suction inlet 13. Slurry enters the suction inlet and moves inward through the length of the suction branch to the eye 22*a* of the impeller 22. The counterclockwise rotation of the impeller 22 pushes the slurry on the back of the impeller vanes 22*b*, imparting radial motion and pressure to the slurry. The slurry is forced outward through a casing discharge branch (not shown) that is typically connected to discharge piping. Depending upon the size of the pump and the rotational velocity of the impeller 22, hundreds or thousands of gallons per minute of slurry are drawn inward through the suction inlet 13 and discharged outward under pressure.

As shown in FIG. 3, the radial seal 30 of the present invention is shown installed in the stationary casing 12 of the centrifugal slurry pump. As shown, the rotating component, i.e., the impeller 22 is conventional and requires no modification. The suction side 12*a* of the pump casing 12, also commonly referred to as the suction liner, has a continuous and circular sealing ring groove 12*b* formed therein with a generally rectangular cross section for receiving the radial seal 30. As used herein, the "radial seal" refers to any type of seal or gasket that is positioned within a holding groove for sealing the wetted surfaces of the casing 12 and impeller 22. Also, as used herein, the term "sealing" refers to the function of reducing leakage or flow between component surfaces. As will be appreciated by those skilled in the art, a complete elimination of leakage or flow between surfaces is not desirable in certain applications.

Groove 12*b* is preferably dimensioned with a depth that is greater than its width. Thus, the groove stably maintains the radial seal 30 in position, without the possibility of any substantial distortion or rotation. At least one water inlet connection 12*c* is provided so that a supply of pressurized clean water may be injected into the groove 12*b* during pump operation or wet layup. As used herein, "clean water" refers to water that is substantially free of solid matter.

Figure 4:
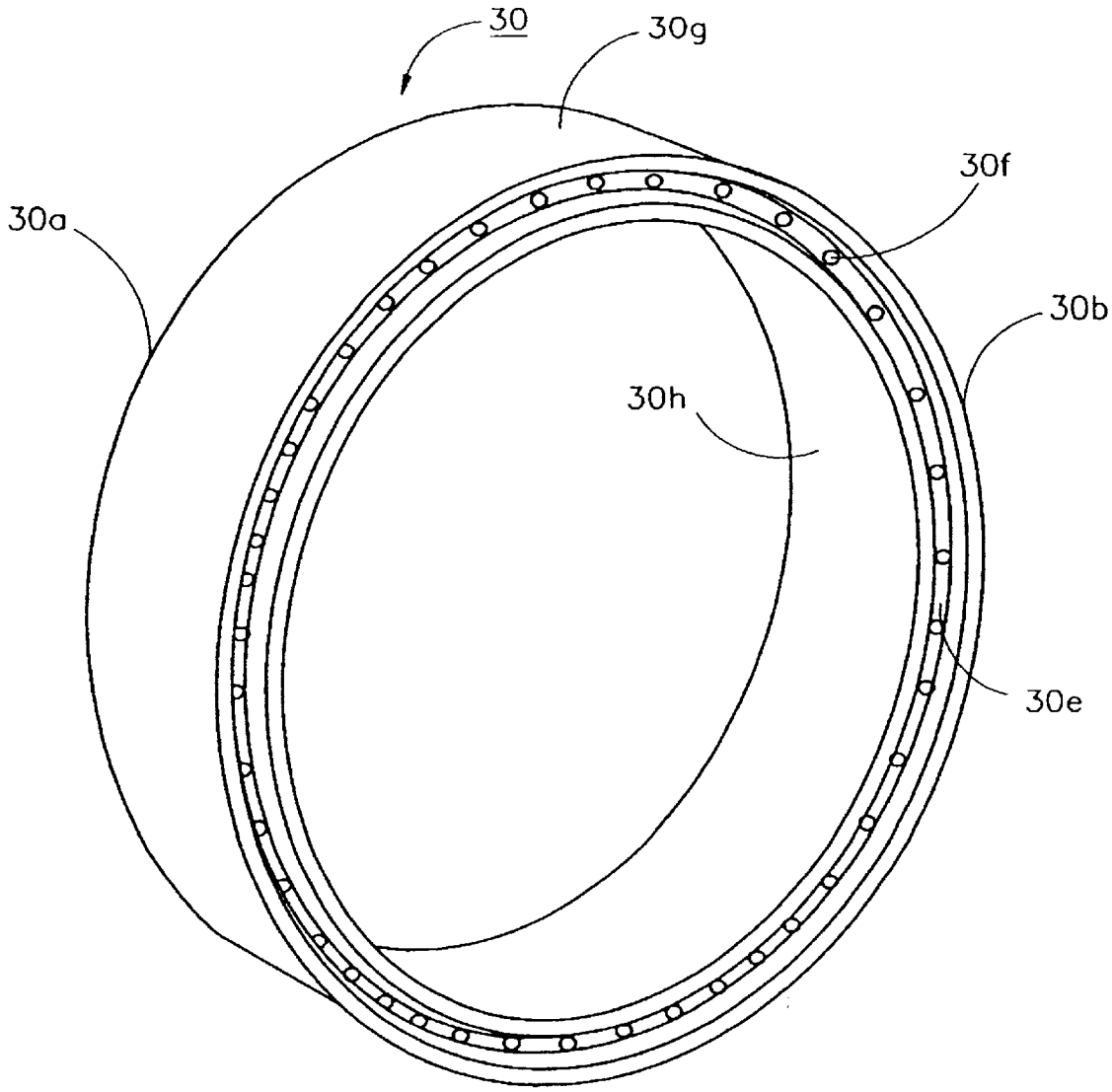
FIG. 4 is a front perspective view of the entire radial seal ring of the present invention with a conical sealing surface and perforations formed through the seal sides and sealing surface.

The complete radial seal 30 is best shown in FIG. 4. The seal 30 is formed of a durable elastomer, ceramic, or malleable metal, such as iron that has a high level of corrosion resistance; however, the selection of materials is not limited thereto. While there is no requirement that the seal material be particularly corrosion resistant because of the continuous flushing with clean water, corrosion resistant materials do, however, increase the service life of the seal 30. The seal 30 is formed as a continuous circular ring. It is sized to be slightly smaller in each dimension than groove 12*b* so that it can move freely laterally within groove 12*b*, but so that it will not twist or otherwise distort. For example, a seal 30 having a thickness of about 1.000 inches and a depth of about 1.500 inches would be seated in a groove 12*b* having a width of about 1.020 inches and a depth of about 2.000 inches.

As shown in FIGS. 3 and 4, seal 30 has an outer end 30*a* seated within groove 12*b*, an inner surface 30*b*, and opposed sides 30*g* and 30*h*. Inner surface 30*b* forms the sealing surface of the seal with respect to the impeller nose surface 22*a*. A series of spaced apart openings 30*c* are formed around the circumference of the outer end 30*a* of seal 30 and extend through the body of the seal 30. These openings 30*c* permit entry and passage of pressurized sealing water entering through inlet 12*c*. As the sealing water passes through an opening 30*c*, it is forced outward through perforations 30*f* that are formed through inner surface 30*b*. Openings 30*c* and perforations 30*f* are sized so that a backpressure is maintained within groove 12*b* between seal 30 and the inner end 12*e* of groove 12*b*. Because the dimensions of openings 30*c* and 30*f* are limited, the application of pressurized flushing water into opening 30*c* creates a "spray nozzle" effect, forcing seal 30 inward toward impeller nose surface 22*a*. Opening 30*c* is sized between 10 percent and 80 percent of the width of the seal.

Figure 6:
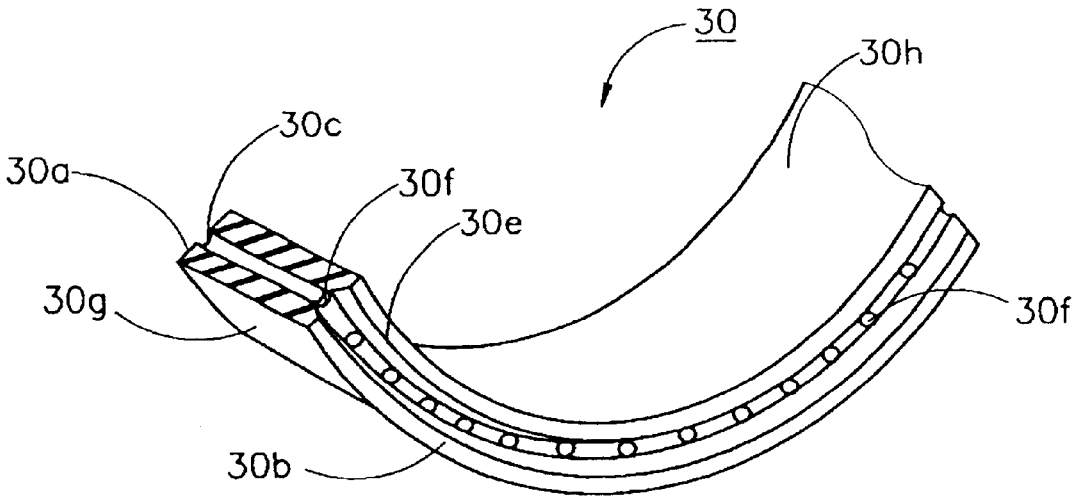
FIG. 6 is a cut-away perspective view of an alternative embodiment of the seal ring of the present invention with a recessed sealing end.
Figure 5:
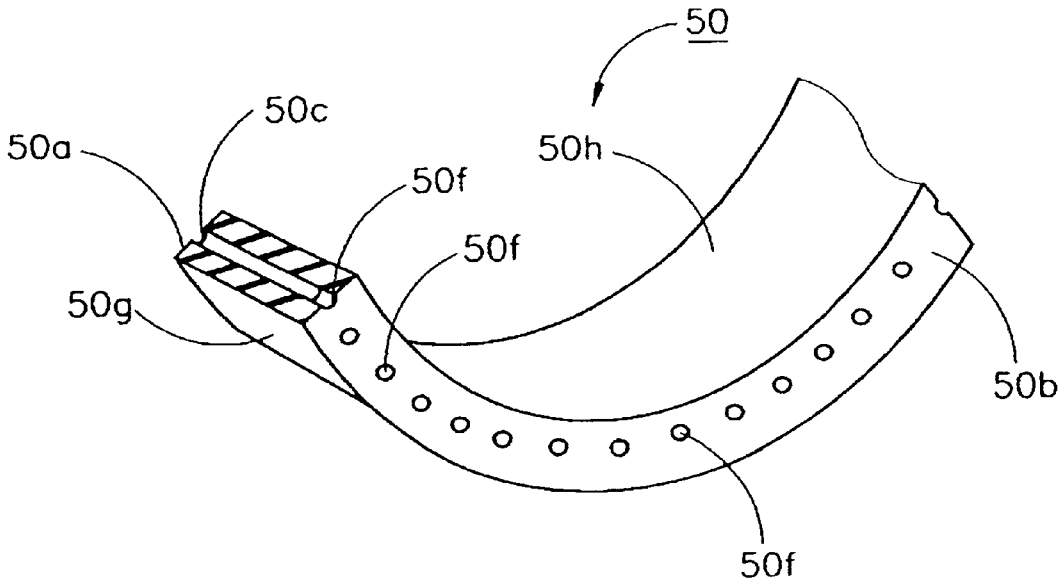
FIG. 5 is a cut-away perspective view of the seal ring of the present invention with a substantially planar sealing surface.

Turning now to FIGS. 5 and 6, two embodiments of the seal of the present invention are shown in cut-away sections. FIG. 5 illustrates a seal 50 having opening 50*c* for the entry of pressurized flushing water into the seal 50. The embodiment shown in FIG. 5 has a sealing end 50*b* that is substantially flat across the entire width of the seal 50. Openings 50*f* are formed therethrough the sealing end 50*b* to communiate with opening 50*c*. The area of the openings 50*c* is sized smaller than the area of groove 12*b* so that a backpressure is created between seal 50 and groove 12*b* when pressurized flushing water is applied through inlet 12*c*.

As shown in FIG. 6, in a second embodiment of the present invention, a substantial portion of the sealing surface of the seal 30 is recessed. FIG. 6 is a cut-away section of the seal 30 already shown in FIGS. 3, 4, and 7. As shown in FIG. 6, the sealing end 30*b* of seal 30 has a recessed portion 30*e* centrally formed in the sealing surface 30*b*. Recessed portion 30*e* is between about 10 percent and about 30 percent of the width of the seal. It has been found that with this configuration, pressurized water passing through openings 30*c* and 30*f* into the recessed portion 30*e* fills and builds pressure in recessed portion 30*e*. This ensures a substantially greater flushing and pressure balancing surface area between seal 30 and impeller nose 22*a*. While the recessed portion 30*e* is shown with a generally conical cross-section, it may be hemispherical, parabolic, etc., so long as it is completely surrounded by portions of sealing end 30*b* such that a backpressure is created when water fills the recessed portion 30*e*.

Figure 7:
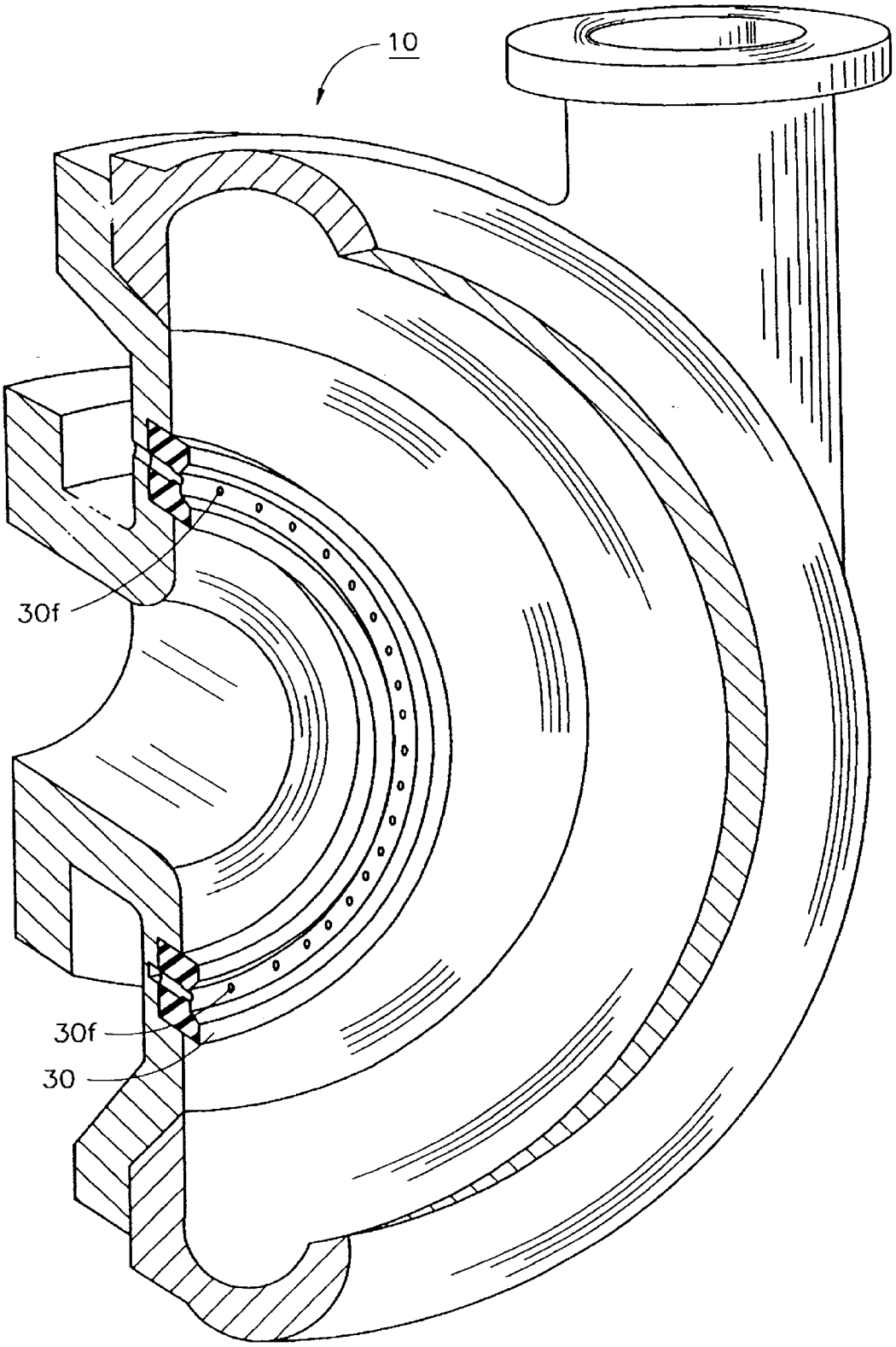
FIG. 7 is a front perspective cut-away view of the centrifugal pump of FIG. 3 with the seal ring of FIG. 6 installed therein.

Referring to FIG. 7, an environmental view of the seal 30 of the present invention is shown installed in a conventional centrifugal slurry pump 10. In operation, pressurized water is injected into groove 12*b* through inlet 12*c*. Desirably, the pressure of the water is between about 1 and 20 pounds per square inch greater than the discharge pressure of the pump. The water passes through openings 30*c*, 50*c* and outward through perforations 30*f*, 50*f*. With the sizes of the perforations 30*f*, 50*f* restricted, the pressure of the sealing water forces the seal 30, 50 laterally outward and into gap 14, defined by the inner surface 12*h* of casing 12*a* and impeller nose surface 22*a* of impeller 22. As seal 30, 50 protrudes outward toward surface 22*a*, the seal water forced through the perforations 30*f*, 50*f* creates a backpressure between seal surface 30*b*, 50*b* and impeller nose surface 22*a*. The backpressure between the opposed surfaces keeps the seal 30, 50 from actually contacting impeller nose surface 22*a*. Thus, the pressurized seal arrangement of the present invention creates a self-compensating clearance between the opposed-.surfaces 30*b*, 50*b* and 22*a*. As surfaces 30*b*, 50*b* are not in contact, there is no frictional seal wear on either the casing 12 or the impeller 22 caused by solid contact. Further, the pressurized water provides a lubricating and cleaning medium for the wetted surfaces of the centrifugal slurry pump 10.

Although the present invention has been described with preferred embodiments, it is to be understood that modifications and variations may be utilized without departing from the spirit and scope of the invention, as those skilled in the art will readily understand. Such modifications and variations are considered to be within the purview and scope of the appended claims and their equivalents.

I claim:

1. A seal for use in a centrifugal pump of the type having an impeller, a sealing ring groove formed in a pump casing, and means for supplying flushing water to the sealing ring groove, comprising:

(a) a radial seal having a sealing end, a water inlet end, and opposed sides and adapted for installation within the sealing ring groove, a cross-section of the radial seal being substantially rectangular, said radial seal having a plurality of openings formed therethrough for the passage of water; and (b) said plurality of openings so dimensioned and so located therethrough said radial seal that when water is supplied to the water inlet end, the water flows through the plurality of openings, wherein the radial seal automatically moves to a self-compensating balanced position between the pump casing and the impeller of the pump.

2. The seal of claim 1 wherein the radial seal is dimensioned smaller than the sealing ring groove, wherein the radial seal can move inwardly and outwardly within the sealing ring groove.

3. The seal of claim 1 wherein the sealing end of said radial seal is substantially flat.

4. The seal of claim 1 wherein the sealing end of the radial seal includes a recessed portion formed therein.

5. The seal of claim 4 wherein said recessed portion is substantially conical.

6. The seal of claim 1 wherein the plurality of openings are so dimensioned that pressurized water forces the radial seal outward from the groove and toward the pump impeller, while permitting the water to flow therethrough the openings.

7. The seal of claim 1 wherein the radial seal is formed of a material selected from the group of materials consisting of a wear-resistant iron, an elastomer, and a ceramic.

8. The seal of claim 1 wherein the plurality of openings comprises:

(a) at least one inlet opening adapted to receive the flushing water; and (b) a plurality of discharge openings formed therethrough said sealing end of the radial seal.

9. A centrifugal pump of the type used for pumping an abrasive slurry, comprising:

(a) a pump having a casing, at least one impeller housed within the casing, a sealing ring groove formed in the pump casing, and means for supplying flushing water;

(b) a radial seal having a sealing end, a water inlet end, and opposed sides and adapted for installation within the sealing ring groove, a cross-section of the radial seal being substantially rectangular, said radial seal having a plurality of openings formed therethrough for the passage of water; and (c) said plurality of openings so dimensioned and so located therethrough said radial seal that when water is supplied to the water inlet end, the water flows through the plurality of openings, wherein the radial seal automatically moves to a self-compensating balanced position between the pump casing and the impeller of the pump.

10. The pump of claim 9, wherein the radial seal is dimensioned smaller than the sealing ring groove, wherein the radial seal can move inwardly and outwardly within the sealing ring groove.

11. The pump of claim 9 wherein the sealing end of said radial seal is substantially flat.

12. The pump of claim 9 wherein the sealing end of the radial seal includes a recessed portion formed therein.

13. The pump of claim 12 wherein said recessed portion is substantially conical.

14. The pump of claim 9 wherein the plurality of openings are so dimensioned that pressurized water forces the radial seal outward from the groove and toward the pump impeller, while permitting the water to flow therethrough the openings.

15. The pump of claim 9 wherein the radial seal is formed of a material selected from the group of materials consisting of a wear-resistant iron, an elastomer, and a ceramic.

16. The pump of claim 9 wherein the plurality of openings comprises:

(a) at least one inlet opening adapted to receive the flushing water; and (b) a plurality of discharge openings formed therethrough said sealing end of the radial seal.

17. A method of sealing a gap between an impeller and a stationary casing of a centrifugal pump of the type having a sealing ring groove formed in the stationary casing and an inlet for supplying flushing water to the sealing ring groove, comprising:

(a) positioning in the sealing ring groove a radial seal having a cross-section of the radial seal being substantially rectangular and the radial seal having a plurality of openings; and (b) supplying pressurized flushing water to the inlet of the sealing ring groove so that water flows through the plurality of openings, causing the radial seal to automatically move to a self-compensating balanced position between the pump casing and the impeller of the pump.

* * * * *